US005265009A

United States Patent [19]

Colavita

[11] Patent Number: 5,265,009

[45] Date of Patent: Nov. 23, 1993

[54] WRISTWATCH GAME CALCULATOR

[76] Inventor: Samuel E. Colavita, 502 Norristown Rd., Horsham, Pa. 19044

[21] Appl. No.: 840,473

[22] Filed: Mar. 13, 1986

Related U.S. Application Data

[63] Continuation-in-part of Ser. No. 597,850, Apr. 9, 1984, abandoned.

[51] Int. Cl.[5] ..... G06F 15/44

[52] U.S. Cl. ..... 364/410; 273/148 R

[58] Field of Search ..... 273/148 R, 1 ES, DIG. 28; 434/128; 364/410, 412

[56] References Cited

U.S. PATENT DOCUMENTS

| | | | |
|---|---|---|---|
| 3,689,071 | 9/1972 | Kucera | 434/129 |
| 3,924,340 | 12/1975 | Tammone | 273/148 R |
| 3,962,800 | 6/1976 | Feldheim | 434/129 |
| 4,014,549 | 3/1977 | Cywar | 434/129 |
| 4,052,073 | 10/1977 | Miller | 434/129 |
| 4,156,928 | 5/1979 | Inose et al. | 273/DIG. 28 |
| 4,339,134 | 7/1982 | Macheel | 364/412 |
| 4,479,181 | 10/1984 | Hanrah | 273/1 ES |
| 4,517,656 | 5/1985 | Solimens et al. | 364/410 |
| 4,531,187 | 7/1985 | Uhland | 364/412 |
| 4,614,342 | 9/1986 | Takashimev | 273/DIG. 28 |

OTHER PUBLICATIONS

*Break the Dealer,* pp. 40, 41, 48–53.

*Primary Examiner*—Roy N. Envall, Jr.
*Assistant Examiner*—David Huntley
*Attorney, Agent, or Firm*—John J. Simkanich

[57] ABSTRACT

A calculator, packaged in a wristwatch-style housing, with wrist strap, is usable by the player of a card game, such as blackjack, in obtaining a game strategy decision or prompt, and contains a keyboard on the wrist housing unit, by which the card game player enters card value and hand designation information. This keyboard drives a display on the wrist housing, and has a microprocessor powered calculator within the housing where the calculator performs the game decision calculations. The results of the calculations drive an output display prompter on the wrist housing to prompt the game player on blackjack decisions.

14 Claims, 4 Drawing Sheets

FIG. 1.
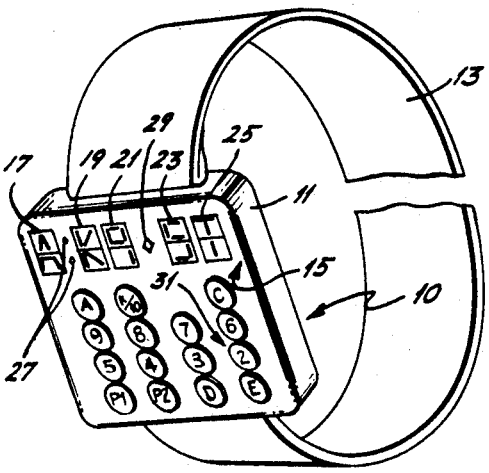
FIG. 2.
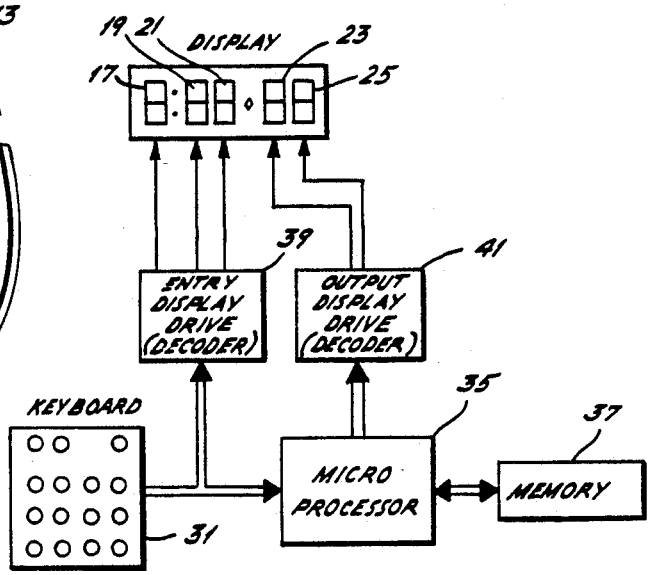
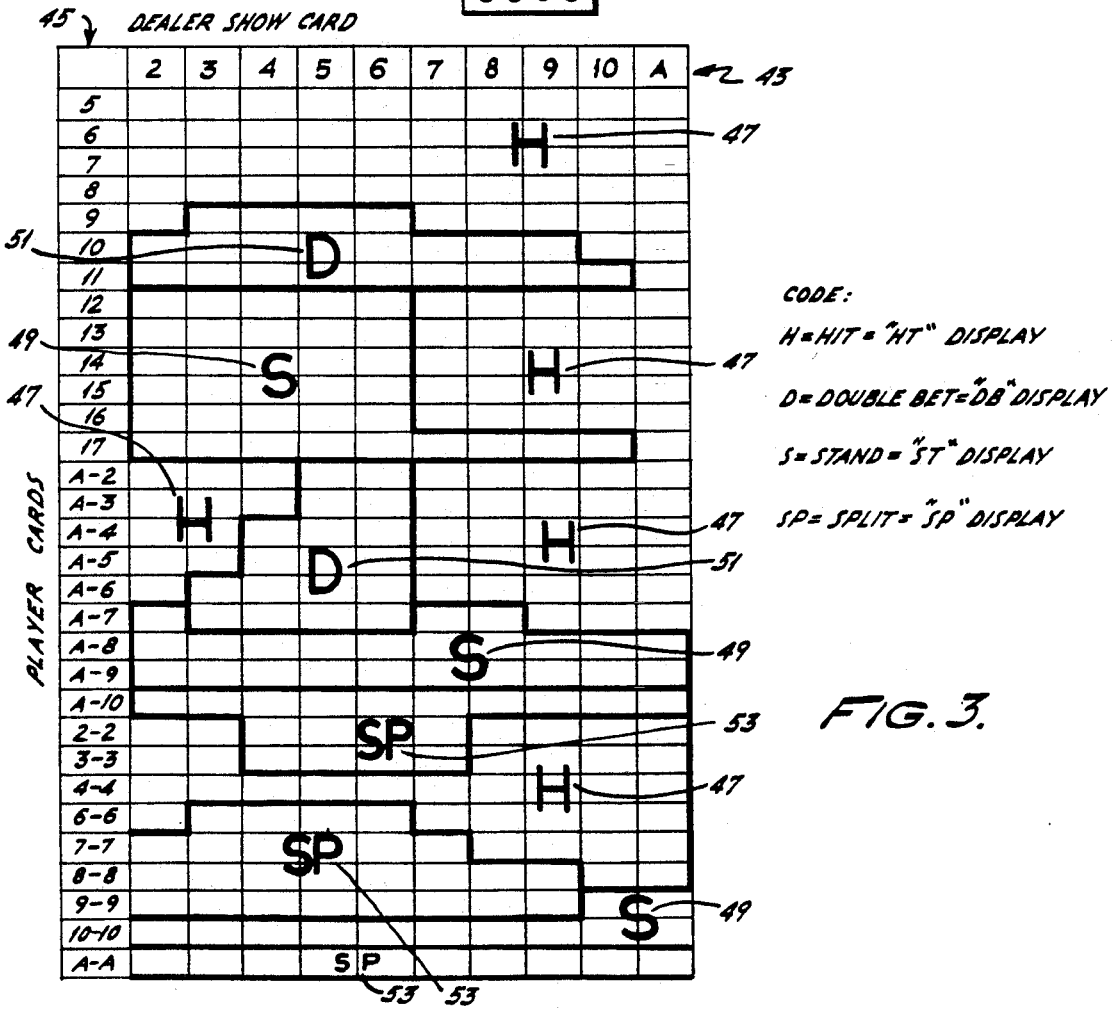
FIG. 3.

WRISTWATCH GAME CALCULATOR

This is a continuation-in-part application for pending application Ser. No. 597,850, filed Apr. 9, 1984, now abandoned.

BACKGROUND OF THE INVENTION

This invention relates to special purpose calculators, and especially those using dedicated electronic components, which are either hard wired or soft wired to perform the dedicated purpose of the calculator. This invention further relates to those types of special purpose calculators which are dedicated to be used in playing card games, such as blackjack.

In the past, there have been blackjack games, blackjack game simulators and blackjack game strategy teaching devices. Blackjack teaching devices include the mechanical scroll type device shown by Tammone, in U.S. Pat. No. 3,924,340. This device has a rotating mechanical scroll member within a rectangular viewing stand. This rectangular viewing stand contains seven windows on its top face, these windows extending across the center portion of this top face in a straight line to display pre-printed information on the scroll. The scroll has a specific predetermined number of dealer and player card combinations printed thereon and requires active participation by the user in interpreting the information in connection with a plurality of labels placed on the top face of the display adjacent the viewing windows.

Kucera, U.S. Pat. No. 3,689,071, shows a blackjack simulator which is a combination slide viewer board game for playing a series of blackjack games from a specific plurality of predetermined card draw simulator.

A programmable television game for teaching the card game of blackjack is shown by Inose et al. in U.S. Pat. No. 4,156,928. This device includes a main control module which is operated under the instructions of a computer program (software) stored in a user tape cassette. The ouput from the control module drives a television which is used as a display device. The user cassette cartridge contains a specific predetermined game play sequence which operates according to a program flow chart. This program is written in BASIC programming language.

A teaching device adapted for the game of blackjack is shown by Feldheim in U.S. Pat. No. 3,962,800. This is an electronic device having a random number generator for the selection of hands stored in memory. Also stored in memory is a corresponding ideal player response for the hand. The circuitry in this device teaches game response by testing a player's response against a stored ideal response.

Like Feldheim, Macheel, in U.S. Pat. No. 4,339,134, shows an electronic blackjack game simulator. Macheel adapts his game into a portable hand held calculator sized apparatus. The Macheel electronic game conducts a simulated blackjack game by "dealing" cards randomly from a full fifty-two card deck of simulated cards. A player entry keyboard is used to enter both numerical money bets and the standard blackjack instructions to the dealer, i.e. "hit", "stand" or "bet". The display provides an output to the player showing a win or a loss of the hand and his total dollar winnings.

Unlike any of the above, Miller in U.S. Pat. No. 4,052,073 shows an electronic decision maker for playing blackjack. The dealer up card and player card count are entered and a strategy or prompt output of "stand", "double down", "hit" or "split" is provided by the energizing, on an exclusive basis, one of four signal lights on the face of the device. The device includes a 38 key keyboard which requires the player to make a decision on the type of play situation. The keyboard is divided into four rows of keys, three rows of which have identical indicia. The first of these three rows of keys is used to input the dealer's up card. The second, third and fourth row of keys are used depending upon the decision made by the player to input the value of the player's first and second dealt cards once an "odds" determination is made by the player himself. Particularly, the second row of keys is used, exclusively, if the player has a pair; the third row is used, exclusively, if the player determines that he has a "soft" count; and the fourth row is used, exclusively, if the player determines two cards he has a "hard" count.

Miller also shows an alternate keyboard configuration. This keyboard has 20 keys to enter the value of the dealer's up card and the player's two cards . It is also used to enter the player's analytical opinion as to a "soft" or "hard" count.

Miller uses a plurality of switching circuits, to provide his signal light output. These circuits operate according to the truth table disclosed as Table I. This table deals with a certain limited combination of and specific sequences of dealer card draws and player card draws.

What is desired is an electronic device which is capable of actively calculating prompts to a player playing a blackjack game. This device should calculate a proper player response for any input of dealer and player cards. It should then provide an instantaneous decision prompt signal to the blackjack player. What is further desired is that the entire apparatus have a simple display and entry keyboard and that the entire device be housed within a wristwatched sized encasement.

An object of the present invention is to provide a wristwatch sized game calculator which is capable of receiving only entries for the dealer up card and the palyer draw cards and for calculating a strategy decision prompt to the player as the result of said entries without requiring player decision making.

A further object of the invention is to provide this calculator with memory capacity for separately keeping track of a plurality of cards drawn to the player in each of two hands when a "split" hand is played.

A further object of this invention is to reset the device to an initial start or clear condition once a hand is played thereby starting the decision or strategy calculation process anew.

An even further object of this invention is to provide a simple output display and a simple input keyboard.

SUMMARY OF THE INVENTION

The objects of the present invention are realized in a wristwatch sized case, which may be worn on the wrist of the game player utilizing a strap or watch band. A keyboard is mounted on the face of the case. This keyboard includes light alpha-numeric keys and two letter keys which are used to enter blackjack card value information. The first value normally entered is the show card of the blackjack dealer. Secondly entered are the draw cards of the player. Three additional alphabet keys are utilized when it is desired to designate the card value entered as the dealer show card and the player, as well as, a player split hand, i.e. the player's first and second hand information. An "execute" key initiates the computational operation, and a "clear" key clears or resets the circuitry.

A five character display is mounted on the face of the case. A first display character is dedicated to display dealer show card value. The display second character is dedicated to display the player card value entered prior to the last card value entered. The third display character is dedicated to display the last card drawn value entered by the player. A fourth and fifth characters display a strategy or decision prompt instruction, calculated as the output of the circuitry, to the player regarding his next move.

The keyboard is directly connected to the first, second and third display characters. The output of the keyboard is also fed to a microprocessor which is connected to a memory. These circuit components operate according to a computational algorithm to calculate an output instruction or prompt which is fed to the fourth and fifth characters of the display.

DESCRIPTION OF THE DRAWINGS

The operation, features and advantages of the present invention will be readily understood from a reading of the following detailed description of the invention in conjunction with the attached drawings in which like numerals refer to like elements and in which:

FIG. 1 shows a perspective view of the wristwatch game calculator;

FIG. 2 shows a block diagram of the electronic circuitry of the calculator invention;

FIG. 3 shows the mathematical decision making algorithm under which the computational circuitry operates to calculate the output to the display for any and all possible combinations of input information from the keyboard;

DETAILED DESCRIPTION OF THE INVENTION

Figure 4:
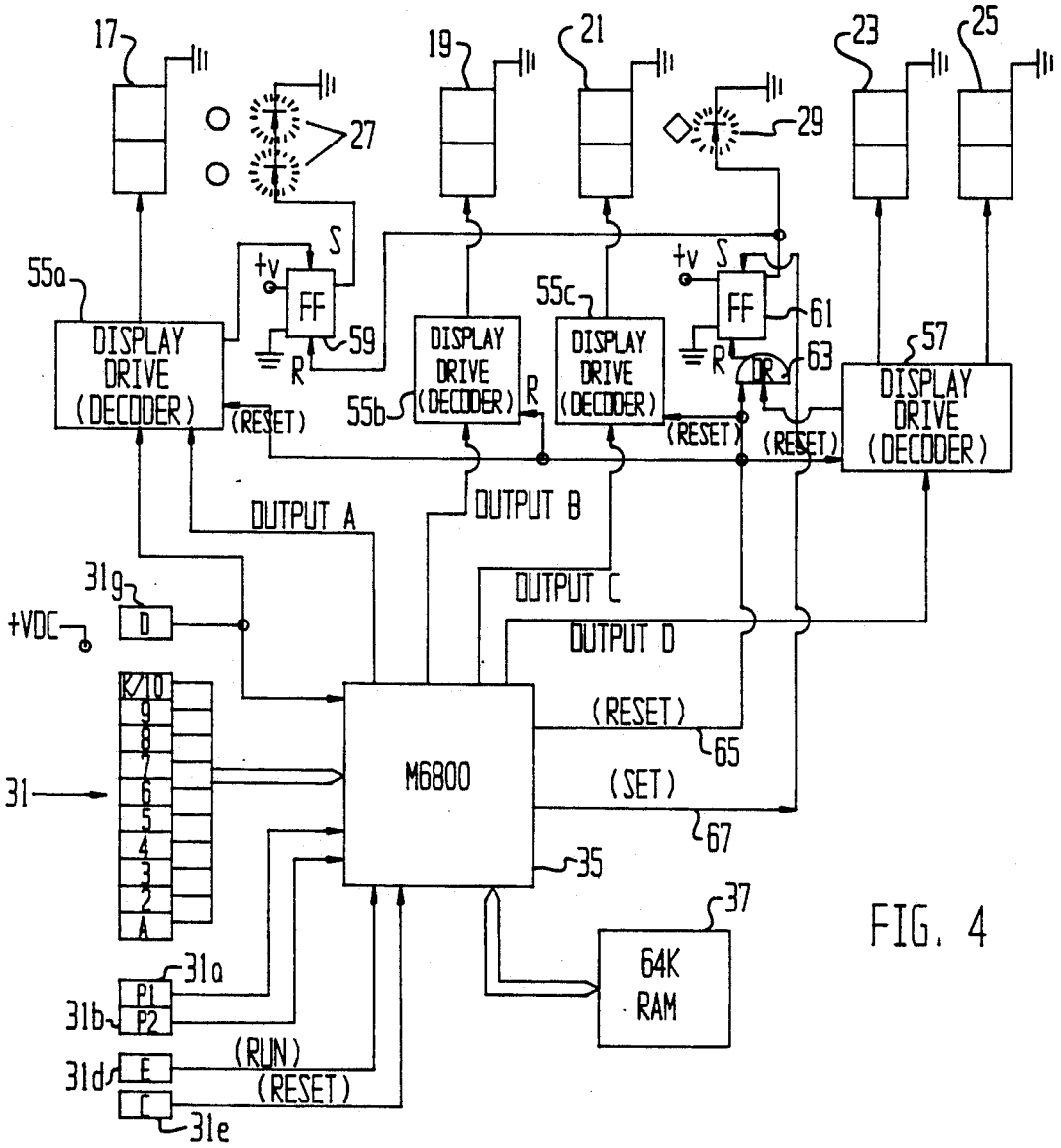
FIG. 4 shows a more detailed block diagram of the is electronic circuitry of FIG. 2.

A wristwatch sized calculator 10, FIG. 1, is specifically dedicated to calculate blackjack play decision prompt to a blackjack player based upon dealer show card and player draw card information entered without requiring game decisions by the player.

This calculator 10 includes a wristwatch sized case 11 supported on a wrist band 13. The case 11 may be of a number of variations of shape but can be conveniently made a rectangular, approaching a box-like configuration. The wrist band 13 can be an expansion band or a wristwatch strap of plastic, leather or woven material.

The face 15 of the case 11 carries a five character display for displaying alphanumeric information. A first display character 17 is dedicated to display the dealer show card value. The second display character 19 is dedicated to display the player's card count prior to his last card drawn. This count never gets above a "10" when a "K" is displayed because the prompt generated automatically becomes the final decision of the player for that particular game as will be discussed below. The third display character 21 is dedicated to display the count value of the last card drawn (and entered) by the player. The fourth and fifth display characters 23, 25 are dedicated to display the output instruction or player prompt.

Positioned between the first and second display characters, 17, 19 may be a pair of round indicator lights 27. These lights light to signal a new value has been entered into the calculator and appears as the first character 17 of the display. Positioned between the third and fourth characters of the display is a diamond shaped indicator light 29. This light energized after the player card information has been entered into the calculator and appears as the second and third display characters of the display 19, 21 and an instruction calculation has begun. When the diamond shaped light goes on, the round lights 27 go off.

A 15-key keyboard 31 is positioned below the display on the face 15 of the case 11. The keys are laid out in a 4×4 matrix with the top position of the third column empty. The bottom row of the keyboard 31 is dedicated to the following key functions respectively from left to right: a player first hand entry key, **31*a* used for split hands; a player second hand entry key, 31*b* used for a second split hand; a dealer entry key 31*c*; and a computation execute instruction key 31*d*. The top right hand corner key 31*e*, is a clear instruction key for circuit reset. The remaining 10 keys on the keyboard 31** are dedicated exclusively to enter values for "2" through "9" cards and an "ace" card and a "10" card or "face" card (10 count card).

Contained within the case 11 is the microprocessor circuitry for carrying out the calculations required by the 15 player. This circuitry includes an M6800 microprocessor chip 35, FIG. 2, supplied by Motorola Corporation. This microprocessor 35 has connected to it a 64K random access memory (RAM) 37 for use as an expanded working memory during calculation.

The output from the keyboard 31 is fed to the input pins of the microprocessor 35 in a conventional manner according to manufacturer specifications, and also to an entry dismay drive (decoder) 39. The entry display decoder 39 drives the first, second and third display characters of the display 17, 19, 21, respectively. The round indicator lights 27 are connected to the output of the display drive 29 for the first display character 17 to light when information has been loaded into that display character 17. The diamond shaped indicator light 29 is connected to light in response to the operation of key **31*d* of the keyboard 31 which initiates the computational process performed by the microprocessor 35 wherein outputs are produced to the fourth and fifth display characters of the display 23, 25. Connection is made in a customary manner. The output from the microprocessor 35 is fed to an output display drive (decoder) 41. This decoder 41 drives the fourth and fifth display characters 23, 25. The clear key is connected to reset the microprocessor 35 the entry display drive 29, the output display drive 41 and the display elements 17, 19, 21, 23, 25 and lights 27, 29**.

Stored within the microprocessor 35 and memory 27 is an instruction set for calculating the output prompt as a function of any possible combination of cards which can appear during the play of the game of blackjack. The programming of this microprocessor 35 is most readily understood from the "truth table" shown as FIG. 3. This truth table is laid out as a rectangular matrix with the top row 43 showing all the possible values of the dealer show card, and the left column 45 showing all possible values of the player draw cards. It is understood that a "10" is the point count for both a ten card and a face card with the exception of an ace when playing blackjack. The implementation of the programming for this truth table is by known practices.

The possible combinations of player cards are shown in column 45 to include combinations where the sum total of a card point count varies from 5 to 19 with no aces and no double cards. Column 45 also includes all combinations of cards with an ace drawn either as a first card or a second card, and all combinations of double cards. The strategy for 5—5 is the same as 10—10.

The regions of the matrix of FIG. 3 labeled with a "H" 47 indicate an output calculation by the microprocessor 35 which produces a "hit" instruction to the output display characters 23, 25. With this instruction the player receives another card. The regions of the matrix labeled an "S" 49 indicate a microprocessor 35 calculation result which provides a "stand" instruction to the output display characters 23, 25. With this instruction the player stops play. The regions of the matrix labeled with a "D" 51 indicate the microprocessor 35 output which results in a double bet instruction to the output display characters 23, 25. Again, with this doubling of his bet, the player stops play. Finally, the regions of the matrix labeled "SP" 53 signify a microprocessor 35 calculation output which provides a split instruction to the display characters 23, 25. With this instruction the card value held in each display being identical values are split into two hands and the "P1" and "P2" keys 31*a*, 31*b* are used to identify two more player card values input.

The microprocessor 35 can be programmed using any of the commonly well known techniques presently in use. Some of these are provided by the manufacturer. These techniques include the solving of simultaneous equations or the functioning of the microprocessor in a decoder mode.

The five displays 17, 19, 21, 23, 25, FIG. 4, are implemented as liquid crystal display elements but can also be implemented with light emitting diodes. Each of the first three displays 17, 19, 21 is connected to be driven by an individual and identical display driver circuit 55*a, b, c*. Both the displays 17, 19, 21 and the drivers 55*a, b, c* are commonly available in the marketplace. The displays 23, 25 are connected to a dual character display driver 57 which is likewise of common technology.

The round indicator lights 27 are implemented by a pair of light emitting diodes 27 which are connected in series. These diodes 27 can be selected of any color such as red and connected from the output of a D type flip-flop 59 to circuit ground. This flip-flop 59 is powered by +VDC on its input and has its "set" terminal connected to an output of the display driver circuit 55*a* for the first display character 17 so that the flip-flop 59 powers the diodes 27 upon the imitiation of a new entry into the first character display element 17.

The diamond indicator light 29 is implemented by a single light emitting diode 29 (LED) which is connected from the output of a second D-type flip-flop 61 to circuit ground. This flip-flop 61 is connected to +VDC on its input and has its set terminal connected to an output terminal for a programmable microprocessor 35. This LED 29 can be green or some other color than the LED's 27.

The keyboard 31 card value keys for "ace", 2 through 9 and 10/face cards are connected, one each, to individual input terminals of the microprocessor 35. The dealer card "D" key 31*c* is connected to the first character 17 display driver 55*a* and to another individual input terminal of the microprocessor 35. Without the "D" key 31*c* signal to first display driver 55*a* the driver 55*a* will not display a dealer card value.

The keyboard player first split hand "P1" key 31*a*, second split hand "P2" key 31*b*, prompt computation execute "E" key 31*d* and clear "C" key 3*le* are also connected to individual input terminals of the microprocessor 35.

The microprocessor 35 can be connected to either operate on rising edges of pulses or falling edges of pulses. The interconnection of a +VDC or a ground to the keyboard 31 will create either, and these techniques are commonly known. The dealer key 31*c*, card value keys and split hand select key 31*a, b* are all connected to data terminals of the microprocessor 35, while the execute key 31*d* is connected to a command terminal which initiates computation and the clear key 31*e* is connected to the reset command terminal to clear the read/write registers within the microprocessor 35. These connections are known and available with the manufacturer's specifications for the device. The 64k ROM memory 37 is connected to the microprocessor 35 in a typical manner. A first data output A from the microprocessor 35 is connected to the first character display driver 55*a*, while a second data output B is connected to the second character display driver 55*b* and a third data output C is connected to the third character display driver 55*c*.

The second flip-flop 61 has its reset terminal connected to the output of an "or" gate 63. This "or" gate 63 has one input connected to the dual character display driver 57 and a second input connected to an output reset signal 65 terminal on the microprocessor. This reset signal 65 is also connected to reset all of the display drivers 55*a, b, c* and 57.

The output terminal from the second flip-flop 61 is also connected to reset terminal on the first flip-flop 59.

A set terminal signal 67 output terminal on the microprocessor 35 is connected to the set terminal of the second flip-flop 61.

The circuit operates so that after being reset, a first card value will appear as the dealer card display 17 and lights 27 will be lighted. The next two card entries will be entered into display 19 and 21 respectively. If no execute command is given, then no further values can be entered without reseting the circuit.

An execute command sets an execute flag and initiates the prompt calculation which yields either a "double" bet, "stay", "hit" or "split" prompt. A double bet and stay instruction to the dealer ends the player's play and no further cards are drawn.

A hit and a split hand instruction to the dealer requires additional play and additional cards are drawn. In these instances, a hit flag and a split flag are set.

The initiation of an execute command causes the diamond light 29 to be lighted. Completion of the execution results in the prompt code being entered into the displays 23, 25 and the diamond light 29 is turned off.

A hit prompt allows another card value to be entered into the display 21 which holds the last card drawn and the previous value displayed in that display 21 to be added to the display 19. While the display 19 is a single character, this does not matter as the program shown in FIG. 3 does not permit a hit or split instruction calling for more cards for values above "10" count, unless there are splits.

Figure 5A:
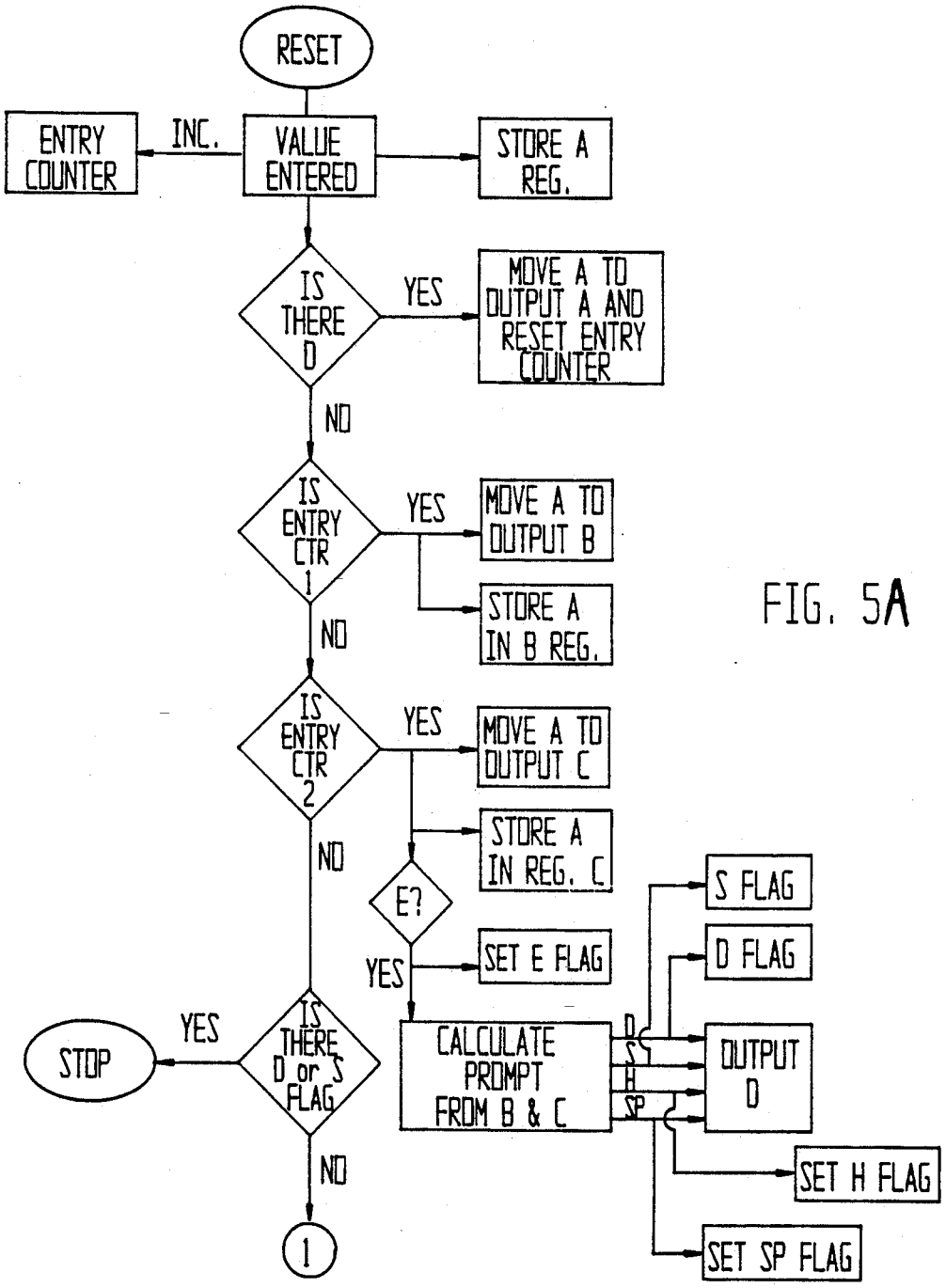
FIG. 5A and B show a flow chart for programming the control of the microprocessor for display functions other than the prompt computations illustrated in FIG. 3.
Figure 5B:
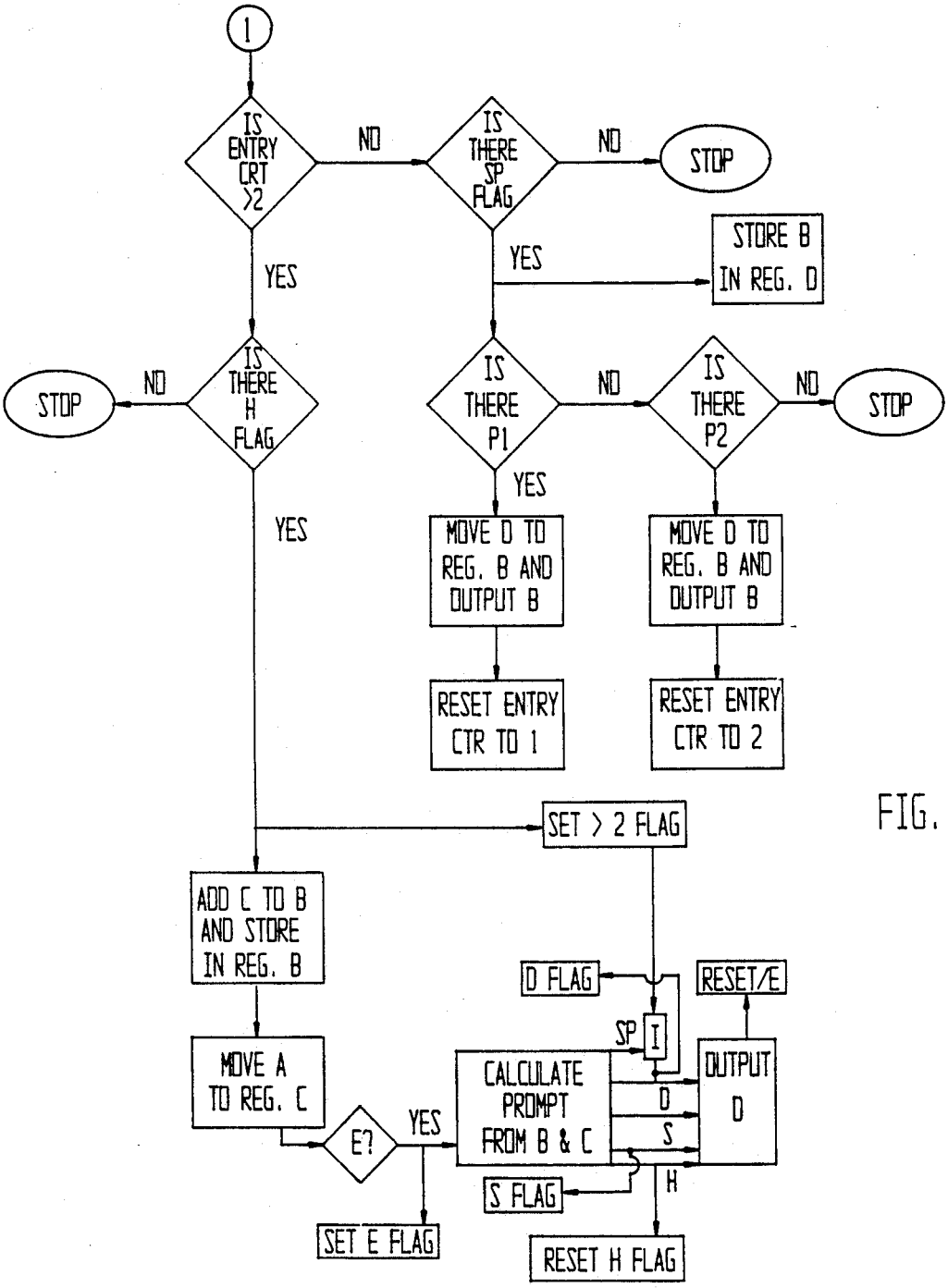

A logic flow for display decision making for display functions is shown in FIG. 5. These functions are performed by the microprocessor 35.

Each "card" value entered is stored in a temporary A register and the number of cards entered are counted. If a dealer key signal is received,the A register value is fed out to the A output. If there is no dealer key signal, then the value is shifted to a B register and also is fed out to the B output as the player first card. A second player card is stored in a C register and fed out to a C output.

Once two player card values are received, the execution of the prompt calculation can be carried out. The prompt output is either a "double (bet) down" command, a "stand" command, a "hit" command and a "split" command. The result of the calculation is fed to a D output and a separate and individual flag is set by each prompt. A "double" or a "stand" flag inhibits further entry of values by the player.

If there is a "split" flag set,then the program stores the split card value in a D register and waits for player 1 hand and player 2 hand signals. Once a P1 or a P2 signal is received, the card count counter is reset to "one" and the program resets itself to go through the program with additional values entered. This is accomplished until one of the split hands plays to completion and the other plays to completion.

If there is no split flag but a hit flag, the value in the C register is added into the B register and a new value entered is stored in the C register. When an execute command is received, the prompt calculation is conducted. In this latter instance, no "split" command or split flag is possible because the players card count would have gone beyond the split possibility.

The above description of the invention is to be taken as illustrative and not in the limiting sense. Many changes can be made without departing from the intent and scope thereof.

I claim:

1. A wristwatch-sized blackjack game decision prompt calculator to provide a play instruction for a given draw which is calculated from a dealer show card value and the player card values entered for that draw, comprising:

a single keyboard for entry of all card values having one individual key for each card value 2 through 9, an "ace" key, a 10/face card key, a first and second player split hand selection keys and a calculator execute key for initiation of calculation of a play prompt;

a display connected to said keyboard to display card value entered as one of an ace, a 10/face card value, a 2 through 9 card value;

computational circuitry connected to said keyboard and to said display for receiving and operating upon each card value entered, said computational circuitry including a microprocessor having a memory containing a software program stored therein for calculating upon attenuation of said execute key based only on the card values entered, a player prompt being one of "hit", "stand", "double", and "split" instructions, wherein one of said instructions is displayed;

wherein said display includes a first character display element for displaying the dealer show card as one of an ace, a 10/face card value, a 2 through 9 card value, a second character display element for showing the card value of a player's hand as one of an ace, a 10/face card value, a 2 through 9 card value, a third character display element for showing the card value of a player's hand as one of an ace, a 10/face card value, a 2 through 9 card value, and a fourth and fifth character display elements for showing a prompt instruction; and wherein each said display elements is connected to said microprocessor; and wherein said computational circuitry further includes:

means for receiving player card values and dealer card values;

means for counting the number of cards entered;

means for determining if every card value entered is a dealer card;

means for displaying said determined value as a dealer card if a dealer card signal is present;

means for displaying a first card value as a player card if not determined as a dealer card;

means for displaying a second card value separately as a second player card if not determined as a dealer card;

means for setting an execute flag which initiates the calculation of a play prompt;

means for calculating a play prompt based on dealer card value and player card values displayed, said prompt being one of hit, stay, split and double;

means for displaying separately the prompt calculated; and means for setting an individual flag representing said prompt calculated.

2. The calculator of claim 1 wherein said keyboard also includes:

a dealer card designation key;

a circuit clear/reset key;

wherein said dealer, player first hand, player second hand and clear/reset keys are connected to said microprocessor.

3. The calculator of claim 2 wherein said first display element includes a first display drive decoder connected to said first display element and being connected from a first output from said microprocessor; wherein said second display element includes a second display drive decoder connected to said second display element and being connected from a second output from said microprocessor; and wherein said third display element includes a third display drive decoder connected to said third display element and being connected from a third output from said microprocessor.

4. The calculator of claim 3 also including a dealer card value entry first signal light circuit connected to said first drive decoder, said dealer card signal light circuit being energized when said first drive decoder loads a value into said first display element.

5. The calculator of claim 4 also including a dual character display drive decoder connected to said fourth and fifth display elements, said dual character decoder being connected from a fourth output of said microprocessor.

6. The calculator of claim 5 wherein said keyboard dealer card designation key is also connected to enable said first display drive decoder.

7. The calculator of claim 6 also including a connection output from said microprocessor to reset said first, second, third and said dual display drive decoders.

8. The calculator of claim 7 also including a second signal light circuit connected to an output of said microprocessor, said second light circuit being energized from said microprocessor during said calculating operations thereof, said second signal light circuit being connected to said first signal light circuit to de-energize said first signal light circuit upon energization of said second signal light circuit.

9. The calculator of claim 8 wherein said first signal light circuit includes a pair of light emitting diodes connected in series to ground and a first flip-flop connected to a power source on its input and to said series connected light emitting diodes on its output, the set terminal of said flip-flop being connected to said first display drive decoder output.

10. The calculator of claim 9 wherein said second signal light circuit includes a third light emitting diode connected to ground and a second flip-flop connected to a power source on its input and to said third light emitting diode on its output, said second flip-flop output also being connected to the reset terminal of said first flip-flop; and said calculator also including an OR gate circuit connected on its output to the reset terminal of said second flip-flop, a first input of said OR gate circuit being connected to an output of said dual display drive decoder and a second input of said OR gate circuit being connected to a drive decoder reset output from said microprocessor.

11. The calculator of claim 1 wherein said calculator calculates said prompt according to the following table wherein "SP" represents a "split" instruction answer, "H" represents a "hit" instruction answer, "S" represents a "stand" instruction answer, and "D" represents a "double bet" instruction answer:

DEALER SHOW CARD

| PLAYER CARDS | 2 | 3 | 4 | 5 | 6 | 7 | 8 | 9 | 10 | A |
|---|---|---|---|---|---|---|---|---|---|---|
| 5 | | | | | | | | | | |
| 6 | | | | | | | | | | |
| 7 | | | | | | | "H" | | | |
| 8 | | | | | | | | | | |
| 9 | | | | | | | | | | |
| 10 | | | "D" | | | | | | | |
| 11 | | | | | | | | | | |
| 12 | | | | | | | | | | |
| 13 | | | | | | | | | | |
| 14 | | | "S" | | | | "H" | | | |
| 15 | | | | | | | | | | |
| 16 | | | | | | | | | | |
| 17, 18, 19 | | | | | | | | | | |
| A-2 | | | | | | | | | | |
| A-3 | "H" | | | | | | | | | |
| A-4 | | | | | | | | "H" | | |
| A-5 | | | | "D" | | | | | | |
| A-6 | | | | | | | | | | |
| A-7 | | | | | | | | | | |
| A-8 | | | | | | | "S" | | | |
| A-9 | | | | | | | | | | |

-continued

| | | | | | | | | | |
|---|---|---|---|---|---|---|---|---|---|
| A-10 | | | | | | | | | |
| 2-2 | | | | "SP" | | | | | |
| 3-3 | | | | | | | | | |
| 4-4 | | | | | | | "H" | | |
| 6-6 | | | | | | | | | |
| 7-7 | | | "SP" | | | | | | |
| 8-8 | | | | | | | | | |
| 9-9 | | | | | | | | "S" | |
| 10-10 | | | | | | | | | |
| A-A | | | | | "SP" | | | | |
| 5-5 | | | | "D" | | | | | "S" |

where the dealer show card row and player cards column entries represent card point count, and where a single entry in a player cards column block represents no ace or duplicate card value to the player.

12. A method carried out entirely by a calculator circuit of displaying black jack hands and calculating play prompts comprising the steps of:

entering player card values and dealer card values;

counting the number of cards entered;

determining if every card value entered is a dealer card;

displaying said determined value as a dealer card if a dealer card signal is present;

displaying a first card value as a player card if not determined as a dealer card;

displaying a second card value separately as a second player card if not determined as a dealer card;

setting an execute flag which initiates the calculation of a play prompt;

calculating a play prompt based on dealer card value and player card values displayed, said prompt being one of hit, stay, split or double;

displaying separately the prompt calculated; and setting an individual flag representing said prompt calculated.

13. The method of claim 12 also including after said last mentioned flag setting step the steps of;

determining if the count of player cards entered is more than two;

determining if a split prompt flag has been set;

determining if a split signal was received;

resetting the card count if a split signal is received; and adjusting said count of player cards until each of the split hands is completed if a split signal was received.

14. A method carried out entirely by a calculator circuit of displaying blackjack hands and calculating play prompts comprising the steps of:

entering player card values and dealer card values;

counting the number of cards entered;

determining if every card value is a dealer card;

displaying said determined value as a dealer card if a dealer card signal is present;

displaying a first card value as a player card if not determined as a dealer card;

displaying a second card value separately as a second player card if not determined as a dealer card;

calculating a play prompt based on dealer card value and player card value displayed, said prompt being one of hit, stay, split and double;

displaying separately the prompt calculated;

setting an individual flag representing said prompt calculated;

determining if the count of player cards entered is more than two;

determining if a split prompt flag has been set;

resetting of the card count if a split signal is received;

adjusting said count of player cards until each hand is completed if a split signal was received;

determining if a hit prompt flag has been set;

adding the entered player card values together to obtain a total being the sum of the values if a hit prompt flag has been set and displaying said total from said addition separately;

displaying the last of said entered card values separately;

calculating another play prompt based on said total from said addition and said last card value entered and displaying said prompt being one of hit, stay, or double instructions; and setting an individual flag representing said hit, stay and double prompt.

* * * * *